US005116648A

United States Patent [19]

Martin et al.

[11] Patent Number: 5,116,648

[45] Date of Patent: May 26, 1992

[54] CHRISTMAS TREE ORNAMENT

[76] Inventors: Mark M. Martin; M. Frances Upp, both of 3934 Sprig Way, Antioch, Calif. 94509

[21] Appl. No.: 672,468

[22] Filed: Mar. 19, 1991

[51] Int. Cl.[5] ..... A47G 1/06

[52] U.S. Cl. ..... 428/7; 40/124.1; 40/152.1; 40/539; 206/232; 229/92.8; 428/14

[58] Field of Search ..... 40/124.1, 152.1, 539; 206/232; 229/92.8; 428/7, 14

[56] References Cited

U.S. PATENT DOCUMENTS

| | | | |
|---|---|---|---|
| 1,038,652 | 9/1912 | Reese | 229/92.8 X |
| 1,063,577 | 6/1913 | Moran | 229/92.8 UR |
| 1,853,622 | 4/1932 | Kennedy | 206/232 X |
| 4,319,418 | 3/1982 | Transport | 40/124.1 |
| 4,510,189 | 4/1985 | Girard | 40/124.1 X |
| 4,510,707 | 4/1985 | Girard | 428/7 X |
| 4,662,093 | 5/1987 | Suttles et al. | 428/14 X |
| 5,025,580 | 6/1991 | Asai | 40/152.1 |
| 5,032,436 | 7/1991 | Gustafson | 428/14 |

*Primary Examiner*—Henry F. Epstein
*Attorney, Agent, or Firm*—Schapp and Hatch

[57] ABSTRACT

What is disclosed is a Christmas tree ornament in the form of a folder of heavy paper, cardboard, or other sheet material, provided with slots adapted for receiving a photograph, a window opposite the location of the photograph, a locking tab and corresponding slot for locking the folder in its closed configuration, and a pair of openings aligned when the folder is in its closed configuration which are located for receiving one end of a conventional Christmas tree ornament hanger.

3 Claims, 2 Drawing Sheets

CHRISTMAS TREE ORNAMENT

BACKGROUND OF THE INVENTION

1. Field of the Invention

Our invention relates to Christmas tree ornaments, and more particularly to personalized Christmas tree ornaments, i.e., Christmas tree ornaments identified with particular persons.

2. Description of the Prior Art

Christmas tree ornaments identified with particular persons or pets have long been known in the prior art.

By way of example, it is known to reproduce the names of family members or other individuals on conventional glass ball Christmas tree ornaments.

Further, it is well known to shape Christmas tree ornaments, e.g., fabricated from bread dough, in forms caricaturing family members, or even family pets.

Yet further, it is known in the prior art to paint representations of human individuals on conventional glass ball Christmas tree ornaments.

Also, it is known in the prior art to fabricate Christmas tree ornaments from heavy paper, cardboard, or pasteboard.

As is well known, however, glass ball Christmas tree ornaments are relatively expensive, particularly those which are hand-painted, and even more so those which are custom hand-painted to represent human individuals, pets, or family homes.

Also, it is well known that conventional glass ball Christmas tree ornaments are very frangible, and thus are dangerous to pets, small children or even adults with bare feet when exposed to the shards of broken ornaments.

Yet further, the personalization of Christmas tree ornaments, especially of the glass globe type, is beyond the ability of many individuals, even if the personalization amounts only to reproducing the name of a person or pet on such a glass globe.

The term "prior art" as used herein or in any statement made by or on behalf of applicant means only that any document or thing referred to as prior art bears, directly or inferentially, a date which is earlier than the effective filing date hereof.

No representation or admission is made that a search has been made, or that no more pertinent information than that given hereinabove exists.

SUMMARY OF THE INVENTION

Accordingly, it is an object of our invention to provide Christmas tree ornaments which may be personalized in one minute or less.

Another object of our invention is to provide personalizable Christmas tree ornaments which are very inexpensive to manufacture and distribute.

Yet another object of our invention is to provide Christmas tree ornaments which while highly decorative and personalized e yet at the same time safer than the conventional glass ball Christmas tree ornaments.

A yet further object of our invention is to provide Christmas tree ornaments which can be personalized in less than a minute and yet at the same time can function not only as Christmas tree ornaments but also as Christmas cards.

Yet another object of our invention is to provide Christmas tree ornaments which while easily personalized in a minute or less are also capable of functioning as gift tags.

An additional object of our invention is to provide Christmas tree ornaments which can be personalized in a minute or less without any special skills or any tools, equipment or supplies other than a small photograph and a pen or pencil.

A yet further object of our invention is to provide Christmas tree ornaments which in addition to their function as Christmas tree ornaments also alternatively function as Christmas cards or gift tags.

Other objects of our invention will in part be obvious and will in part appear hereinafter.

Our invention, accordingly, comprises the apparatus embodying features of construction, combinations of elements, and arrangements of parts which are adapted to effect such steps, all as exemplified in the following disclosure, and the scope of our invention will be indicated in the appended claims.

In accordance with a principal feature of our invention Christmas tree ornaments are provided which comprise a folder of heavy paper, cardboard, or other rigid or semi-rigid sheet material, which folder is provided with a plurality of slots for receiving the corners of a personal photograph and an opening positioned to confront such photograph when the folder is folded to its closed position.

In accordance with another principal feature of our invention the outer contour of said folder takes the shape of a Christmas tree ornament.

In accordance with yet another principal feature of our invention such folder is provided with a tab-and-slot closure whereby the folder can be maintained in its closed condition, with said photograph confronting said opening, without the use of any kind of adhesive.

In accordance with another principal feature of our invention said folder is also provided on its outer surface with suitable space for handwriting the name of a donor and a recipient thereof.

In accordance with another principal feature of our invention said folder is provided at one end with a pair of openings which are aligned when the folder is closed, thereby providing means for securing a conventional Christmas tree ornament hanger to the folder.

For a fuller understanding of the nature and objects of our invention, reference should be had to the following detailed description, taken in connection with the accompanying drawings.

DESCRIPTION OF THE PREFERRED EMBODIMENTS

Figure 1:
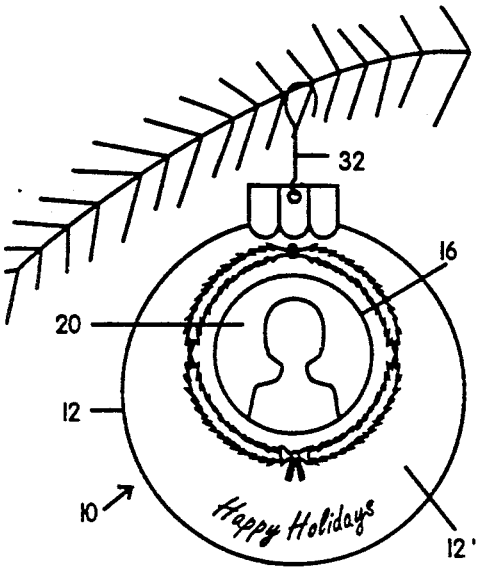
FIG. 1 is a view in elevation of the front face of a Christmas tree ornament constructed in accordance with our invention, in which is mounted a photograph of a human individual.
Figure 2:
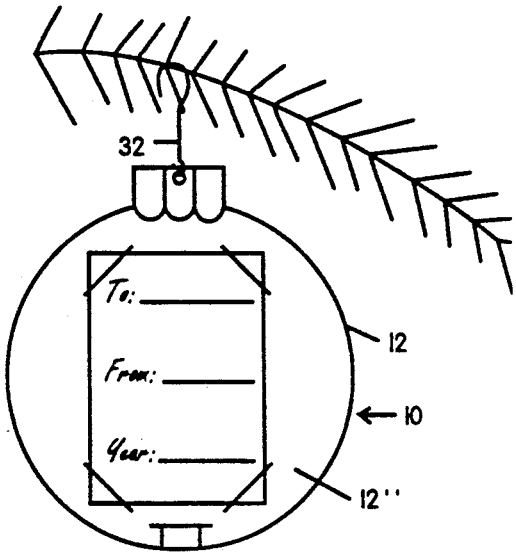
FIG. 2 is a rear view in elevation of the Christmas tree ornament of our invention shown in FIG. 1.
Figure 3:
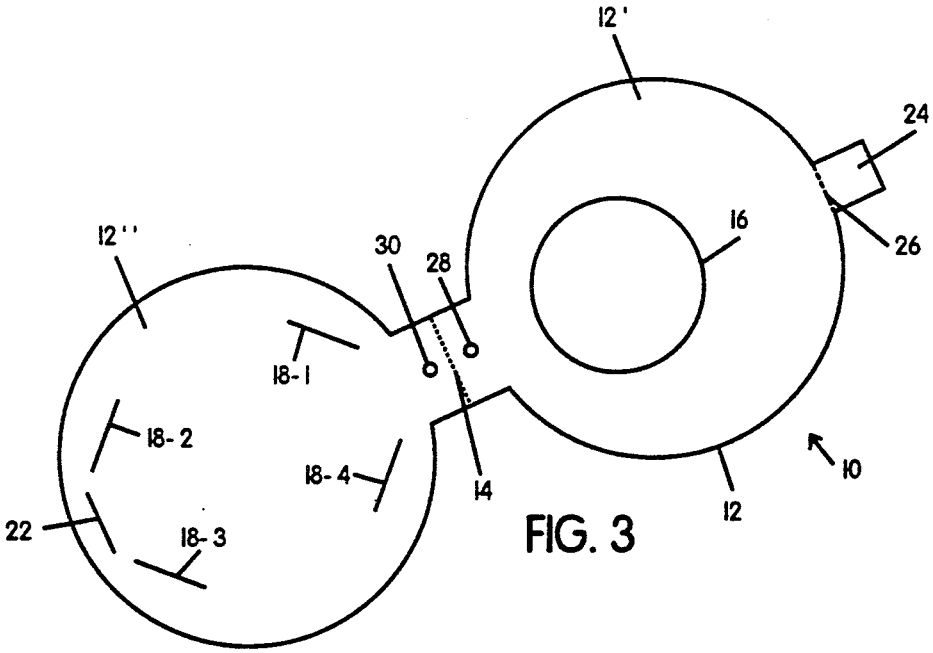
FIG. 3 is a plan view of the inner face of the Christmas tree ornament of FIGS. 1 and 2.

Referring now to FIGS. 1 through 3, there is shown a Christmas tree ornament 10 embodying our invention.

As see in FIG. 3, Christmas tree ornament 10 is principally comprised of a folder 12 fabricated from cardboard, stiff paper, or like stiff sheet material.

As further seen in FIG. 3, folder 12 is provided with a hinge crease 14 whereon it can easily be bent so that its front panel 12' and its rear panel 12" immediately confront each other, and are at least partially in contact, as shown in FIGS. 1 and 2.

As further seen in FIG. 3, folder 12 is provided with an opening or window 16, also shown in FIG. 1.

Also shown in FIG. 3 are four slits 18-1, 18-2, 18-3, 18-4 preformed in the back panel 12" of folder 12, into which slits a small photograph of a human being may be locked in the well known manner; such a photograph being thus locked on the inner face of back panel 12" so that it is viewable through opening or window 16 when folder 12 is completely closed. Such a photograph 20 is shown in FIG. 1 wherein photograph 20 is seen through window 16, the front and rear panels 12', 12" being locked together in the manner hereinafter described.

As also seen in FIG. 3, folder 12 is provided with an additional preformed slit 22 adapted to receive a tongue 24, whereby the back panel 12" and the front panel 12' of folder 12 are locked together with their inner faces, shown in FIG. 3, in confrontation. For convenience in manipulating tongue 24 into slit 22 a crease 26 is provided as shown in FIG. 3.

As yet further seen in FIG. 3, folder 12 is provided with two small openings 28, 30 disposed on opposite sides of crease 14 and equidistant therefrom. As will be evident to those having ordinary skill in the art, openings 28, 30 are in alignment when folder 12 is closed and locked in its closed position by tab 24 and slit 22, and thus a single opening is provided for receiving one end of a Christmas tree ornament hanger 32 (FIGS. 1 and 2).

As seen in FIG. 2, the rear face of folder 12 is provided with imprinted lines adapted to guide the user in endorsing the rear face of Christmas tree ornament 10 with the name of the donor and the name of the recipient thereof. By this means, Christmas tree ornament 10 is adapted to function as a Christmas gift tag, in addition to its function as a Christmas tree ornament.

As will be evident to those having ordinary skill in the art, informed by the present disclosure, the Christmas tree ornament of our invention can be made sufficiently small in area to be contained in a suitable envelope and mailed as a Christmas card.

Figure 4:
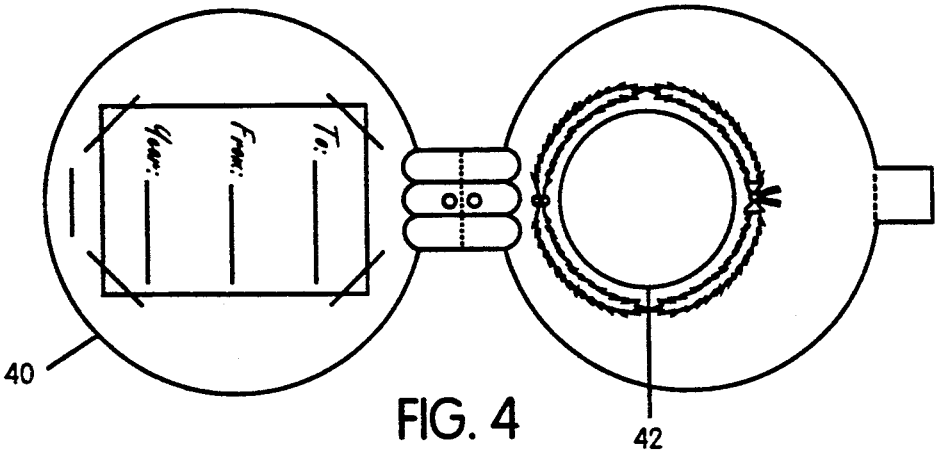
FIG. 4 is a plan view of the outer face of a Christmas tree ornament similar to the Christmas tree ornament shown in FIGS. 1 through 3.

Referring now to FIG. 4, there is shown the outer face of the folder of a Christmas tree ornament 40 of a second preferred embodiment of our invention, which is substantially identical to Christmas tree ornament 10 of the first preferred embodiment of our invention except for the decorative imprint surrounding window 42.

Figure 5:
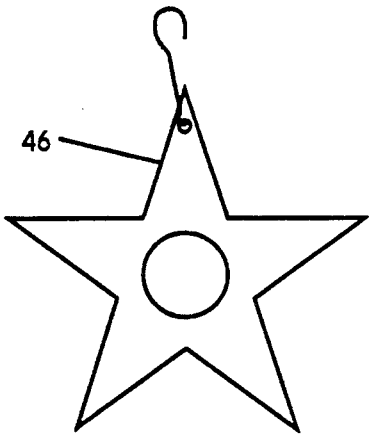
FIGS. 5 through 7 are illustrations of alternative embodiments of the Christmas tree ornament of our invention.
Figure 6:
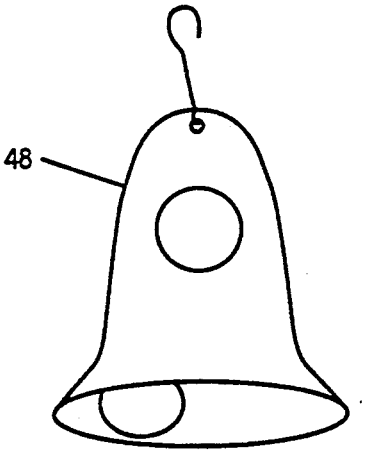
Figure 7:
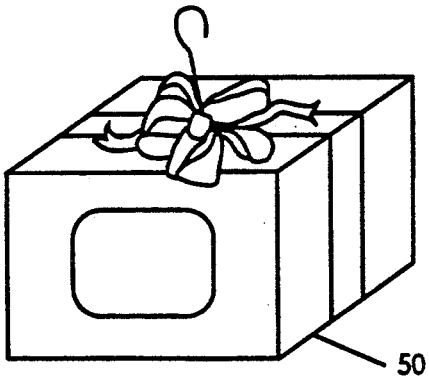

Referring now to FIGS. 5 through 7 there are shown alternative embodiments of the Christmas tree ornament of our invention, differing substantially from the Christmas tree ornament of the first preferred embodiment only in their shape or outer contour.

It will thus be seen that the objects set forth above, among those made apparent from the preceding description, are efficiently attained, and since certain changes may be made in the above constructions and the method carried out thereby without departing from the scope of our invention, it is intended that all matter contained in the above description or shown in the accompanying drawings shall be interpreted as illustrative only, and not in a limiting sense.

It is also to be understood that the following claims are intended to cover all the generic and specific features of our invention hereindescribed, and all statements of the scope of our invention which, as a matter of language, might be said to fall therebetween.

What is claimed is:

1. A christmas tree ornament, comprising:

a first panel of stiff sheet material;

a second panel of stiff sheet material;

bridge means joining said panels, said bridge means having a transverse crease and a hole on each side of said crease for receiving a Christmas tree ornament hanger;

means for securing a photograph to said second panel; and a window opening in said first panel positioned to confront said photograph when said panels are in contact with said photograph secured therebetween;

at least one of said panels being contoured to a silhouette of a conventional three-dimensional Christmas tree ornament.

2. A christmas tree ornament as claimed in claim 1 further comprising a tongue projecting from one of said panels and a slit in the other one of said panels adapted to receive said tongue and thus to lock said panels into mutually confronting relation with said photograph secured therebetween.

3. A christmas tree ornament as claimed in claim 1, further comprising the words "To" and "From" and accompanying writing lines imprinted on the outer face of said second panel, whereby said ornament can also be used as a gift tag.

* * * * *